US005483745A

United States Patent [19]

Izumi

[11] Patent Number: 5,483,745

[45] Date of Patent: Jan. 16, 1996

[54] ELECTRIC SHAVER

[75] Inventor: Shunji Izumi, Matsumoto, Japan

[73] Assignee: Izumi Products Company, Nagano, Japan

[21] Appl. No.: 389,019

[22] Filed: Feb. 15, 1995

[30] Foreign Application Priority Data

Aug. 19, 1994 [JP] Japan ..... 6-195206

[51] Int. Cl.[6] ..... B26R 19/28

[52] U.S. Cl. ..... 30/43.6; 30/DIG. 2

[58] Field of Search ..... 30/43.4, 43.5, 30/43.6, DIG. 1, DIG. 2; 310/47, 50, 112

[56] References Cited

U.S. PATENT DOCUMENTS 3,043,996 7/1962 Hartwig et al. .

3,141,239 7/1964 Meyer et al. ..... 30/43.6

3,369,294 2/1968 Shaw et al. ..... 30/43.6

3,717,780 2/1973 Hohne, Jr. et al. ..... 310/112

4,910,869 3/1990 Labrijn ..... 30/43.6

*Primary Examiner*—Hwei-Siu Payer

*Attorney, Agent, or Firm*—Koda and Androlia

[57] ABSTRACT

An electric shaver including a plurality of motors and corresponding number of shearing units each substantially comprising an inner cutter and an outer cutter. The inner cutter of each one of the shearing units is directly connected to one of the motors so that each inner cutter is directly driven by each motor. The shearing units are arranged, for example, so as to be at corners of a triangle in the head portion of the shaver housing.

6 Claims, 4 Drawing Sheets

ELECTRIC SHAVER

BACKGROUND OF THE INVENTION

1. Field of the Invention

The present invention relates to an electric shaver and more particularly to an electric shaver having a plurality of cutting or shearing units.

2. Prior Art

The driving mechanism of a conventional electric shaver is shown in FIG. 7.

The shaver housing 12 is provided with an opening 12*a* in the head, and an outer cutter frame 30 is fastened to this opening 12*a*. A mounting plate 14 is installed in the shaver housing 12 apart from the outer cutter frame 30, and a single motor 16 is mounted on this mounting plate 14. The output shaft 16*a* of the motor 16 protrudes from the mounting plate 14, and a drive gear 18 is attached to the end of the output shaft 16*a*. The drive gear 18 engages with three transmission gears 20 (only one is shown) which are rotatable on the mounting plate 14 via a gear shaft. The transmission gears 20 are arranged so that they are at corners of an imaginary equilateral triangle.

Each one of the transmission gears 20 is engaged with a tubular transmission shaft 24. The tubular transmission shaft 24 has a flange 24*b* at the root end, and the flange 24*b* is set inside a guide tube 20*b* of the transmission gear 20. The guide tube 20*b* has an inwardly extending projection 20*c* that prevents the transmission shaft 24 from slipping out. Thus, the transmission gear 20 and the tubular transmission shaft 24 are simultaneously rotated by the motor 16. A spring 21 is installed between the tubular transmission shaft 24 and the guide tube 20*b* so that the tubular transmission shaft 24 is kept pushed outwardly or to the left in the drawing.

Outer cutters 36 (only one shown) are installed in the outer cutter frame 30 in an unrotatable fashion. Each outer cutter 36 has an annular shaving surface 37, and radial slits 37*a* are formed as hair entry openings over the entire shaving surface 37*a*. In addition, a groove 37*b* is formed in the undersurface of the shaving surface of the outer cutter 36. On the other hand, an inner cutter is attached to each one of the transmission shafts 24. The inner cutter is comprised of a central disk 39 and a plurality of arms 39*a* projecting from the central disk 39. Blades 40 which slide along the inner surface of the groove 37*b* of the outer cutter 36 are installed at the ends of the arms 39*a* so as to be guided by the grooves 37*b* of the outer cutter 36. The central disk 39 of the inner cutter is fit over the tip end of the tubular transmission shaft 24.

In the above, the outer cutter 36 and the inner cutter 38 make a shearing or cutting unit. Thus, the convention shaver described above has three shearing or cutting units.

However, the conventional electric shaver as described above has problems. The power of the single motor 16 is transmitted to three inner cutters 38 via three transmission gears 20 via a single drive gear 18. As a result, an abnormal noise is generated from the engaging portions of the gears during rotation.

More specifically, the transmission gears 20 are mounted on the gear shafts 22, and some play is inevitable. In addition, the driving force is transmitted to the respective transmission gears 20 from the single drive gear 18; as a result, the force tends to be transmitted unevenly. In other words, the driving force tends to apply onto one portion of the transmission gear 20 and not evenly to the entire circumference of the transmission gear 20. As a result, together with the play between the transmission gears 20 and the gear shafts 22, the transmission gears 20 are likely to make oscillations in the axial direction.

Such axial shifting of the transmission gears 20 is not avoidable. More specifically, the blades 40 of the inner cutters 38 are guided by the grooves 37*b* of the outer cutters 36, and therefore, the axes of the tubular transmission shafts 24, outer cutters 36 and inner cutters 38 can coincide by the axis shift of the tubular transmission shafts 24 in the radial direction. However, the axes of the transmission gears 20 and tubular transmission shafts 24 cannot coincide in this manner. In other words, the axes of the gear shafts 22 and the axes of the tubular transmission shafts 24, inner cutters 38 and outer cutters 36 are not able to coincide perfectly. As a result, some of the driving force is lost during transmission.

As seen from the above, the conventional shaver includes a plurality of shearing units; and therefore, when a load from shearing the hair is onto one of the shearing units, the effect of this load causes the performance of the other shearing units to drop, thus decreasing the overall performance of the shaver.

As described above, the tubular transmission shafts 24 have a structure that can absorb some axial shifting, and also the tubular transmission shafts 24 can move in the radial direction. Accordingly, the blades 40 of the inner cutter 38 are guided by the grooves 37*b* of the outer cutters 36, so that even if the axes of the gear shafts 22 are not perfectly aligned with the axes of the inner cutters and the outer cutters, this discrepancy can be absorbed and hairs can be sheared by the outer cutters 36 and inner cutters 38. However, if the outer cutters are dome-shaped blades or have a convex top having mesh-form hair entry holes, axial misalignment is not permissible because the dome-shaped outer cutters have curved surfaces that do not allow the inner cutters to be guided by the outer cutters.

SUMMARY OF THE INVENTION

Accordingly, the present invention is to eliminate the problems of the prior art shavers.

The main object of the present invention is to provide an electric shaver which reduces driving noise and eliminates transmission loss of the driving force.

The object of the invention is accomplished by a unique structure for an electric shaver that comprises a plurality of shearing units each comprising an outer cutter in which through-holes or slits are formed as hair entry holes and an inner cutter which rotates over the inner surface of the outer cutter so as to and shear off the hairs, and the unique structure of the invention is that the shaver includes a plurality of motors and the output shaft of each one of the motors is connected to each one of the inner cutters so that each inner cutter is rotated by each motor directly and independently.

In the above, a single battery can be connected in series to each one of the motors, and the thus serially connected pairs of motors and batteries can be connected in parallel.

Accordingly, since the output shaft of the respective motor is directly connected to the inner cutter of the respective shearing unit, there is no need to use power transmission gears as in the conventional shaver. Thus, noise is prevented, and since the inner cutters are connected to the output shafts of the motors directly, there is no axial shifting during the rotation of the inner cutters.

DETAILED DESCRIPTION OF THE INVENTION

Preferred embodiments of the electric shaver of the present invention will be described in detail with reference to the accompanying drawings.

Figure 1:
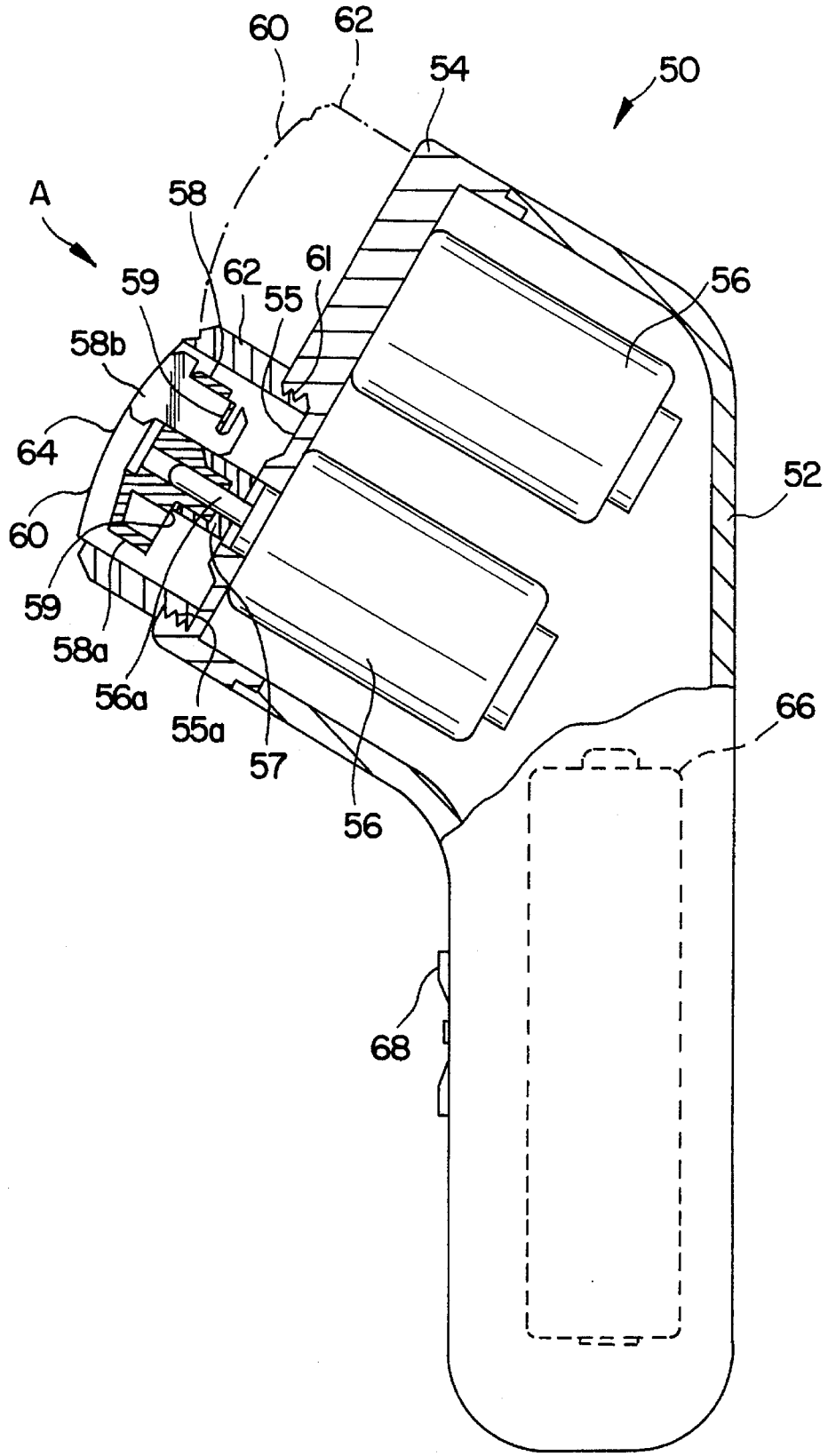
FIG. 1 is a partial cross-section of the electric shaver of the present invention.
Figure 2:
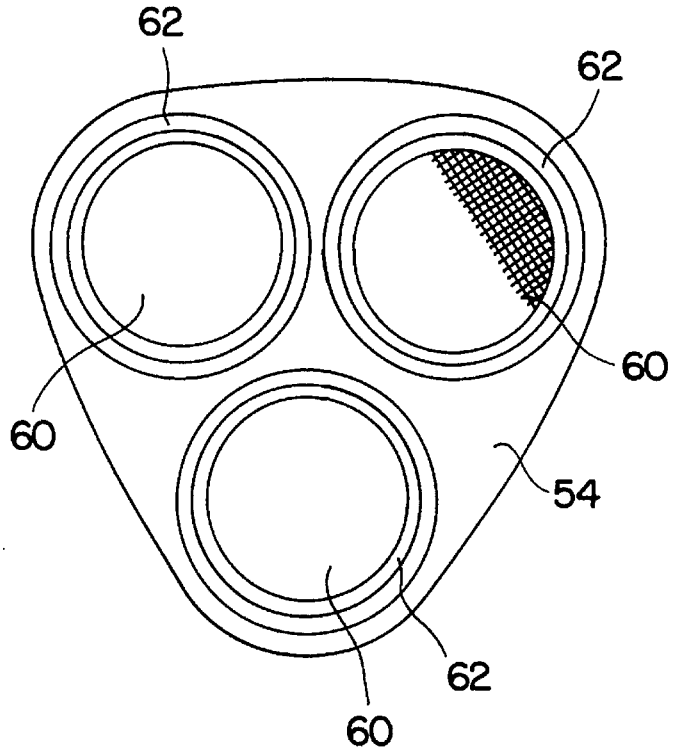
FIG. 2 is shows the head of the shaver looking along the arrow A of FIG. 1.

As seen in FIG. 1, a head plate 54 which has the shape of a reverse equilateral triangle as shown in FIG. 2 is installed at the top of a shaver housing 52 of the electric shaver 50. Three motors 56 are fastened to one surface of the head plate 54. FIG. 1 shows only two motors. These motors 56 are positioned so as to be at three corners of an imaginary reversed triangle that is a similar figure to the head plate 54. The following description will be made on one of the three motors and the components provided on such one motor, and the description on these is common to all three motors and related components.

The output shaft 56*a* of the motor 56 penetrates to another surface of the head plate 54. A circular recess 55 is formed in the head plate 54 so as to surround the penetrated output shaft 56*a*.

An inner cutter 58 is fastened to the output shaft 56*a* of the motor 56 via a pressure-fitting element 57. The inner cutter 58 includes a blade holder 58*a*, that fits over the output shaft 56*a*, and radially disposed plurality of blades 58*b* that are secured to the blade holder 58*a*. The blades 58*b* are urged by a plate spring 59 in the direction opposite from the motor 56. The plate spring 59 is held in place by the pressure-fitting element 57 and the inner cutter 58.

Furthermore, an attachment tube 62 is installed to the head plate 54 in a manner so that it covers the inner cutter 58. In other words, the attachment tube 62 includes a dome-shaped top that has a mesh-form outer cutter 60 at one end and an external screw 61 at the inner or root end. The external screw 61 of the attachment tube 62 is engaged to an internal screw 55*a* formed on the inside circumferential surface of the recess 55 of the head plate 54. Thus, the attachment tube 62 can be unscrewed and detached from the head plate 54.

Thus, when the motors 56 are driven, the inner cutters 58 rotate, and the blades 58*b* of the inner cutters 58 slide on the under surfaces of the outer cutters 60, cutting the hair. The inner cutters 58 are pushed by the plate springs 59 so that the inner cutters 58 are kept in contact with the under surfaces of the outer cutters 60.

In the above structure, each pair of the inner cutter 58 and outer cutter 60 makes a shearing unit 64.

Three batteries 66 are accommodated inside a battery case (not shown) provided in the lower section of the shaver housing 52 as a power source. So as to activate the power source, a switch 68 is provided on the shaver housing 52.

Figure 3:
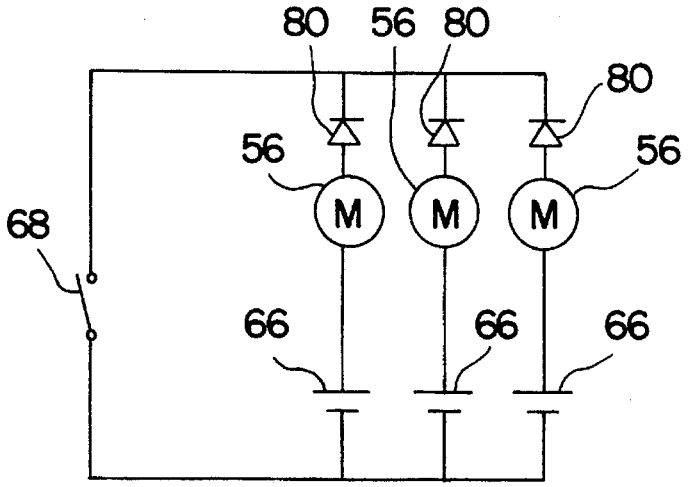
FIG. 3 is an electric circuitry employed in the electric shaver of the present invention.

FIG. 3 shows the electric circuitry of the shaver, or it shows the relationship between the motors 56 and the power sources. As shown in this Figure, each battery 66 is connected in series to one of three motors 56, and the thus serially-connected batteries 66 and motors 56 are connected in parallel with each other. Thus, a battery 66 is independently connected to a motor 56. Accordingly, even if a load from the shearing of the hair is applied onto one of the motors 56 and the current is increased in that motor, the other motors 56 are unaffected, since current is supplied to the other motors from respective serially-connected batteries 66.

Diodes 80 may be installed in series with the respective motors 56. This arrangement prevents the back-flow of current to the motors 56.

Instead of by the batteries, the shaver can be operated by domestic AC power supply.

Figure 4:
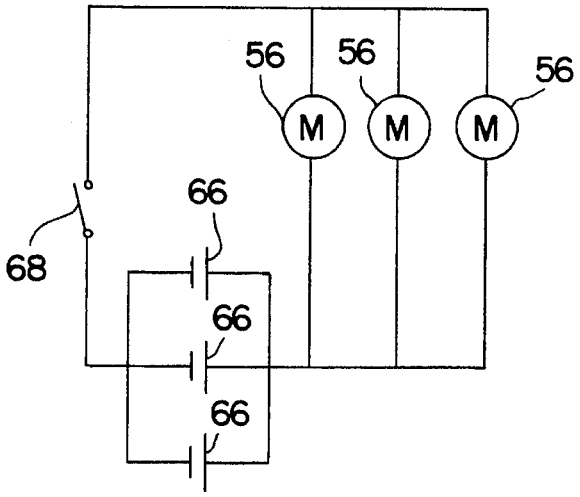
FIG. 4 is another electric circuitry in the present invention.

The electrical circuitry can be as shown in FIG. 4. In this arrangement, the respective motors 56 are connected in parallel, and the thus parallel-connected motors 56 are connected in series to parallel-connected batteries 66. In this case, however, when a load is applied to one of the motors 56, the voltage of the other motors 56 might drop, leading to a reduced rotation or to even a complete stop. Accordingly, the circuit shown in FIG. 3 would be preferable.

Figure 5:
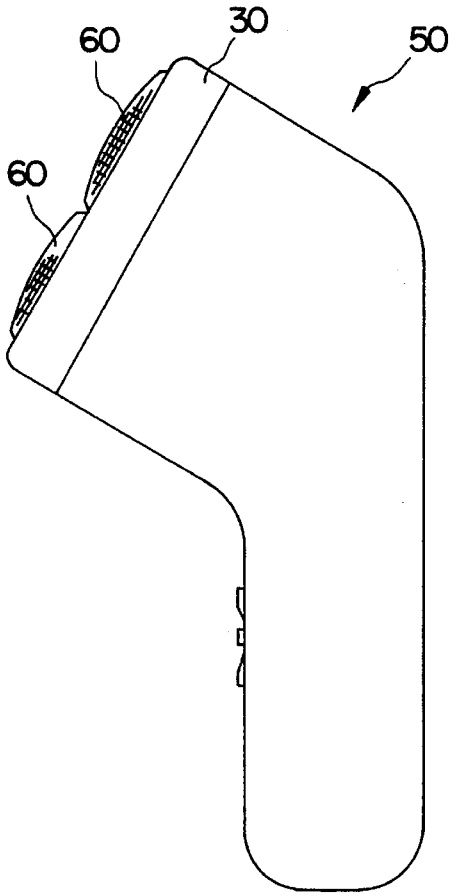
FIG. 5 is a side view of another embodiment of the electric shaver of the present invention.

In the embodiment described above, each of the inner cutters 58 is covered by a respective attachment tube 62. However, it would be possible to fasten the outer cutters 60 to a single outer cutter frame 30, as shown in FIG. 5 and as in the conventional shaver, and then cover the head plate 54 with the outer cutter frame 30.

Figure 6:
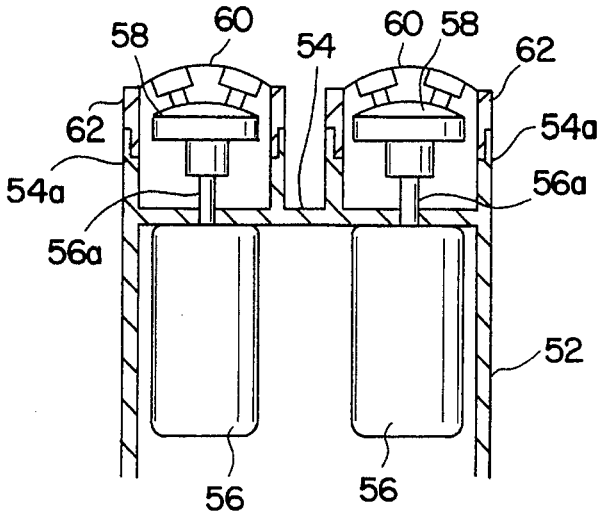
FIG. 6 is a cross-section of a two-head or a "two-eyed" electric shaver.

Furthermore, the above embodiment is described on a "three-eyed" shaver that includes three shearing units each including the inner cutter and the outer cutter; however, a "two-eyed" electric shaver containing two shearing units could also be constructed. FIG. 6 shows a cross section of the head part of such a two-eyed electric shaver. In this embodiment, two attachment tubes 62 are screwed (and therefore in a detachable fashion) into two projecting tubes 54*a* which project from the head plate 54, and two motors are used for activating the two shearing units.

Figure 7:
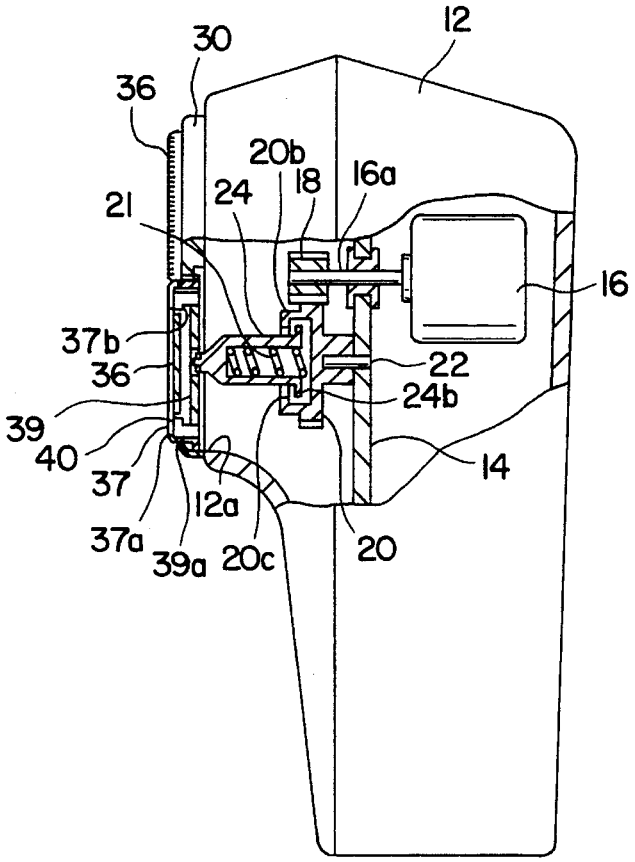
FIG. 7 PRIOR ART
FIG. 7 is a cross-section of a conventional electric shaver.

In the case of an electric shaver which includes inner cutters and outer cutters with slits as seen in the conventional shavers, the present invention applies to such shaver so that the output shafts of the motors are connected directly to the central disks (for example, 39 in FIG. 7) of the inner cutters.

The present invention is not limited to the embodiments described above, and it goes without saying that numerous modifications are possible within the spirit of the invention.

As described in detail in the above, according to the present invention, the output shafts of respective motors are directly connected to the inner cutters of the shaver. Therefore, there is no need for using an intermediate, power-transmitting element such as gears, etc., and no gear engagement noise is generated. Thus, the electric shaver is quiet during use. Furthermore, since no gears are used, the driving force can be transmitted smoothly and efficiently to the inner cutters without any loss. Moreover, the number of parts needed is less, the structure is simple, and assembly is easy.

In addition, since in the present invention the inner cutters and the output shafts of the motors are directly connected, no axial oscillation occurs. It is, therefore, possible to construct an electric shaver that includes a plurality of shearing units with dome-shaped outer cutters.

Furthermore, the motors are individually linked to the respective shearing units, the motors and batteries are respectively connected in series, and the serially-connected motors and batteries are connected in parallel. Accordingly, even if load is applied to only one shearing unit, the other shearing units are unaffected, and hairs can be sheared evenly.

I claim:

1. An electric shaver including a plurality of shearing units each comprising an outer cutter provided with hair entry openings and an inner cutter rotatable on an under surface of said outer cutter to shear the hair, wherein a plurality of motors are further provided in a housing of said shaver and an output shaft of each of said motors is connected to each one of inner cutters so as to independently rotate said inner cutter.

2. An electric shaver according to claim 1, wherein said outer cutter has a dome-shaped top having mesh-form hair entry openings, and said inner cutter comprises a blade holder that is provided with blades in a radial direction of said blade holder so that said output shaft of said motor is connected to said blade holder.

3. An electric shaver according to claim 1, wherein said shearing units are arranged so as to be at corners of a reversed equilateral triangle.

4. An electric shaver according to claim 1, further comprising a head plate and attachment tubes, said head plate being provided at one end of the housing of said shaver so that said motors are mounted on one side of said head plate with output shafts of said motors protruding to another side of said head plate, and said attachment tubes being detachably mounted to said another side of said head plate so as to surround said inner cutters.

5. An electric shaver according to claim 1, further comprising a head plate and an outer cutter frame, said head plate being provided at one end of the housing of said shaver so that said motors are mounted on one side of said head plate with output shafts of said motors protruding to another side of said head plate, and said outer cutter frame being provided on said head plate so as to cover said inner cutters and being provided with outer cutters which positionally correspond to said inner cutters.

6. An electric shaver according to claim 1, further comprising a plurality of power sources each connected in series to each one of said motors, and said serially-connected motors are connected in parallel with batteries.

* * * * *